United States Patent [19]

Perry

[11] 4,136,817

[45] Jan. 30, 1979

[54] VARIABLE-SIZE CARTON BLANK

[75] Inventor: Gerald E. Perry, Martinsville, Va.

[73] Assignees: Southeast Container Corporation, Martinsville, Va.; Willis H. White, Salisbury, N.C.

[21] Appl. No.: 870,568

[22] Filed: Jan. 18, 1978

[51] Int. Cl.[2] ..... B65D 5/66; B65D 5/22

[52] U.S. Cl. ..... 229/33; 229/34 R

[58] Field of Search ..... 229/33, 36, 34 R

[56] References Cited

U.S. PATENT DOCUMENTS

| | | | |
|---|---|---|---|
| 1,270,642 | 6/1918 | Martin, Jr. | 229/34 R |
| 2,037,839 | 4/1936 | Wagenseller | 229/33 |
| 2,077,694 | 4/1937 | Hinton | 229/33 |
| 2,251,565 | 8/1941 | Forman | 229/36 X |
| 2,707,587 | 5/1955 | Wittstein | 229/33 X |
| 2,988,259 | 6/1961 | Callinicos | 229/34 R |
| 3,251,532 | 5/1966 | Hechtman et al. | 229/33 |
| 3,371,842 | 3/1968 | Hechtman et al. | 229/33 |
| 3,598,303 | 8/1971 | Folz | 229/34 R |

*Primary Examiner*—Davis T. Moorhead
*Attorney, Agent, or Firm*—R. Lewis Gable

[57] ABSTRACT

A blank of suitable materials such as corrugated paper board of generally rectangular configuration is provided with two fold lines spaced equally from opposite long edges of the blank and is provided with three fold lines spaced equally from each of the short ends of the blank with the spacing of the fold lines determining the depth of the carton to be produced. A pair of spaced fold lines are provided adjacent to the middle portion of the blank at right angles to the long edges thereof and spaced at the same distance as the other fold lines to provide the back for the carton and to provide along one edge thereof a hinge line for the top of the carton. Certain of the fold lines are cut to provide tabs and each short side of the blank is provided with spaced tabs to lock the components of the carton together in assembled condition. At least six cartons of variable sizes may be folded from the carton blank.

18 Claims, 16 Drawing Figures

Fig 9.
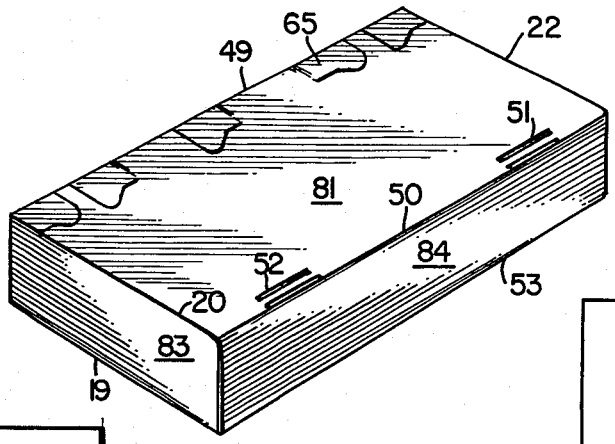
Fig 16.
SIZE 6
Fig 15.
SIZE 5
Fig 10.
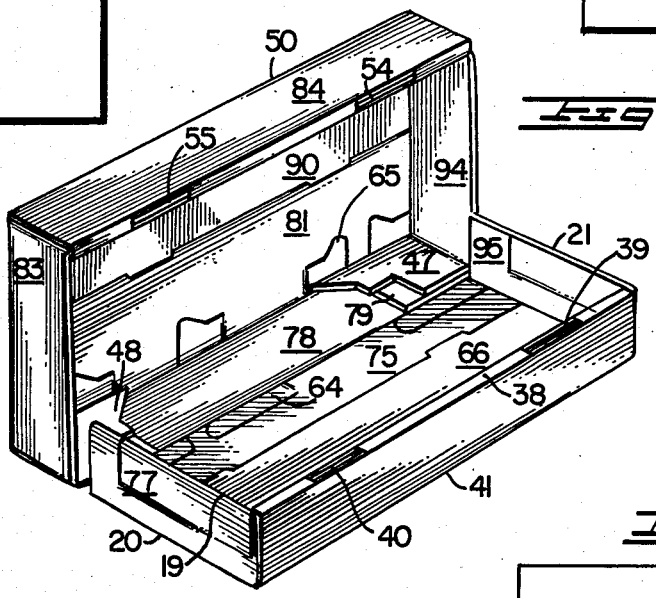
Fig 13.
SIZE 3
Fig 11.
SIZE 1
Fig 14.
SIZE 4
Fig 12.
SIZE 2

VARIABLE-SIZE CARTON BLANK

BACKGROUND OF THE INVENTION

Heretofore various carton blanks have been suggested having fold lines and tabs to lock the components of the carton together in assembled condition to provide a single size carton as in the patent to J. A. Wittstein, U.S. Pat. No. 2,707,587 granted May 3, 1955, for Packing Cartons. In one embodiment of the Packing Cartons of this patent the top is hinged to the back wall thereof. It is also usual in the prior art, as shown in the patent to M. Hechtmann et al, U.S. Pat. No. 3,371,842 granted March 5, 1968, to provide a carton blank having fold lines to provide walls for the carton and walls for the top of the carton with the top of the carton hinged to the top of the back wall thereof. Further, the patent to George W. Fotz, U.S. Pat. No. 3,598,303 granted Aug. 10, 1971, for a Variable Size Box Form discloses a box form having spaced fold lines to provide an open box of various sizes and various heights with tabs provided on certain of the folding members to lock the carton in assembled position.

SUMMARY OF THE INVENTION

A rectangular sheet of foldable material provides a carton blank having spaced parallel first edges and spaced parallel second edges at right angles thereto. First spaced tabs extend from each of the second edges. First, second and third spaced parallel fold lines parallel to each of the second edges are provided in the sheet with second spaced tabs in each of the first fold lines. Spaced slots are cut in each of the second fold lines to receive the first spaced tabs. Spaced slots are cut adjacent to the third fold lines to receive the second spaced tabs. Fourth and fifth spaced parallel fold lines are provided in the sheet parallel to each of the first edges and a sixth fold line is found in the sheet parallel to the second edges forming the rear bottom edge of the completed carton. A seventh fold line found in the sheet is spaced from and parallel to the sixth fold line forming the upper read edge of the top of the completed carton. Tabs are provided in the sheet at each end of each of the fourth fold lines foldable about the second fold line and tabs are provided in the sheet at each end of the sixth fold line foldable about the seventh fold line. The fold lines are spaced at a distance substantially equal to the depth of the completed carton.

REFERENCE TO THE ACCOMPANYING DRAWINGS

A preferred embodiment of the carton blank of the present invention is shown in the accompanying drawings in which FIG. 1 is a view of a rectangularly shaped carton blank in accordance with the present invention disposed with the elements thereof forming the bottom of the carton disposed at the right of the figure and the elements thereof forming the top of the carton disposed at the left of the figure;

FIG. 9 is a perspective view of another size of carton in closed condition formed from the blank of FIG. 1;

FIG. 10 is an open view of the carton of FIG. 9 to show the manner of folding of the components of the blank of FIG. 1 to obtain this size carton;

FIG. 11 is a plan view of the largest size carton obtainable from the blank of FIG. 1, formed and folded as shown in FIGS. 2, 3 and 4;

FIG. 12 is a plan view of the size of carton obtained from the blank of FIG. 1, formed and folded as shown in FIGS. 7 and 8;

FIG. 13 is a plan view of the size of carton obtained from the blank of FIG. 1, formed and folded as shown in FIGS. 5 and 6;

FIG. 14 is a plan view of the size of carton obtained from the blank of FIG. 1, formed and folded as shown in FIGS. 9 and 10; and FIGS. 15 and 16 are plan views of further sizes of cartons obtained from the blank of FIG. 1.

DESCRIPTION OF THE PREFERRED EMBODIMENT

While the preferred embodiment of the present invention takes the form of a rectangular blank it is clear that a square blank could equally be employed if the various sized cartons folded therefrom are to be square rather than rectangular.

Further, the advantages of a single blank from which various size cartons can be formed is established in the prior art by noting that storage is simplified for the user of cartons and the flexibility in selecting the size of the carton to be formed enables the user to select the proper size suitable for the contents of the carton.

Still further, costs are greatly decreased when, as in the present invention, a carton blank can be formed into various sizes of cartons without destruction of the blank so that the blank can be re-used at other times to provide other sizes of cartons as may be required.

It is further most advantageous to provide a carton blank not requiring the use of adhesives or metal fasteners to hold the components of the blank in carton-forming condition and to provide the blank with tabs and slots to hold the elements thereof when the blank is formed into a carton for the ready-assembly and disassembly of the carton in all of its various sizes.

Figure 1:
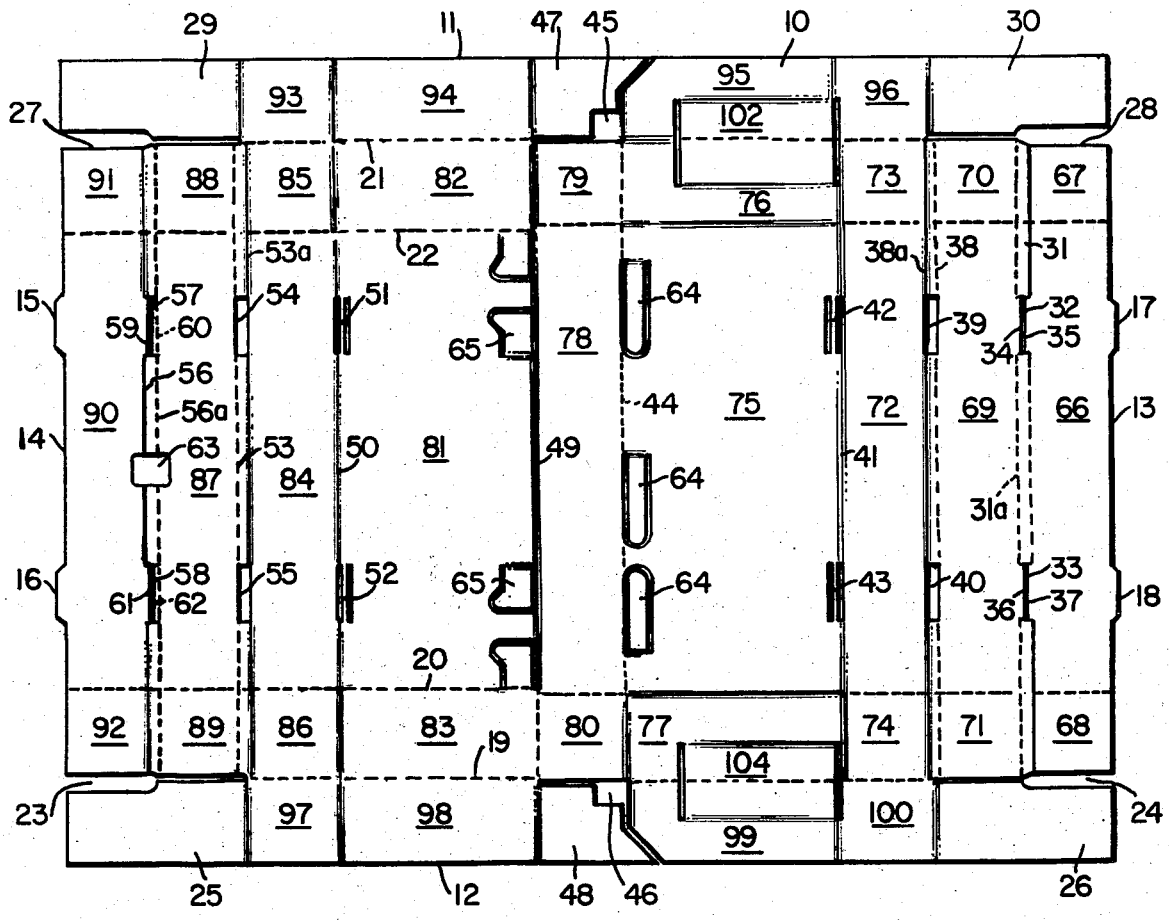

These advantages and others which will appear more fully hereafter are found in the carton blank of FIG. 1 where the carton blank 10 is of generally rectangular shape having long parallel edges 11 and 12 and shorter parallel end edges 13 and 14. Edge 14 is provided with extending tabs 15 and 16 while edge 13 is provided with extending tabs 17 and 18 for purposes which will appear more fully hereinafter.

Fold line 19 is provided in blank 10 parallel to edge 12 and is spaced therefrom the desired depth of the carton and fold line 20 is disposed parallel to fold line 19 and spaced therefrom the desired depth of the carton.

Fold line 21 is provided parallel to edge 11 in blank 10 and spaced therefrom the desired depth of the carton with fold line 22 disposed parallel to fold line 21 and spaced therefrom the desired depth of the carton.

Fold line 19 is cut away adjacent each end thereof at 23 and 24 to provide tabs 25 and 26, respectively. Fold line 21 is cut away adjacent each end thereof as at 27 and 28 to form tabs 29 and 30, respectively.

A fold line 31 is disposed parallel to edge 13 in blank 10 and is spaced therefrom the desired depth of the carton and is cut away at cuts 32 and 33 to provide opposed tabs 34 and 35 and 36 and 37, respectively. Fold line 38 is provided in blank 10 parallel to fold line 31 and spaced therefrom the desired depth of the carton and fold line 38 is cut away at 39 and 40 to receive tabs 17 and 18 as will appear more fully hereinafter. Fold line 41 in blank 10 is spaced from fold line 38 the desired depth of the carton and blank 10 is slotted adjacent thereto as at 42 and 43 to receive tabs 34 and 35, and 36 and 37, respectively, as will appear more fully hereinafter. Hinge of fold line 44 is provided in blank 10 and is spaced parallel to fold line 41 the width of the narrowest of the cartons to be formed and fold line 44 is cut away adjacent each end thereof as at 45 and 46 to form tabs 47 and 48, respectively.

Figure 4:
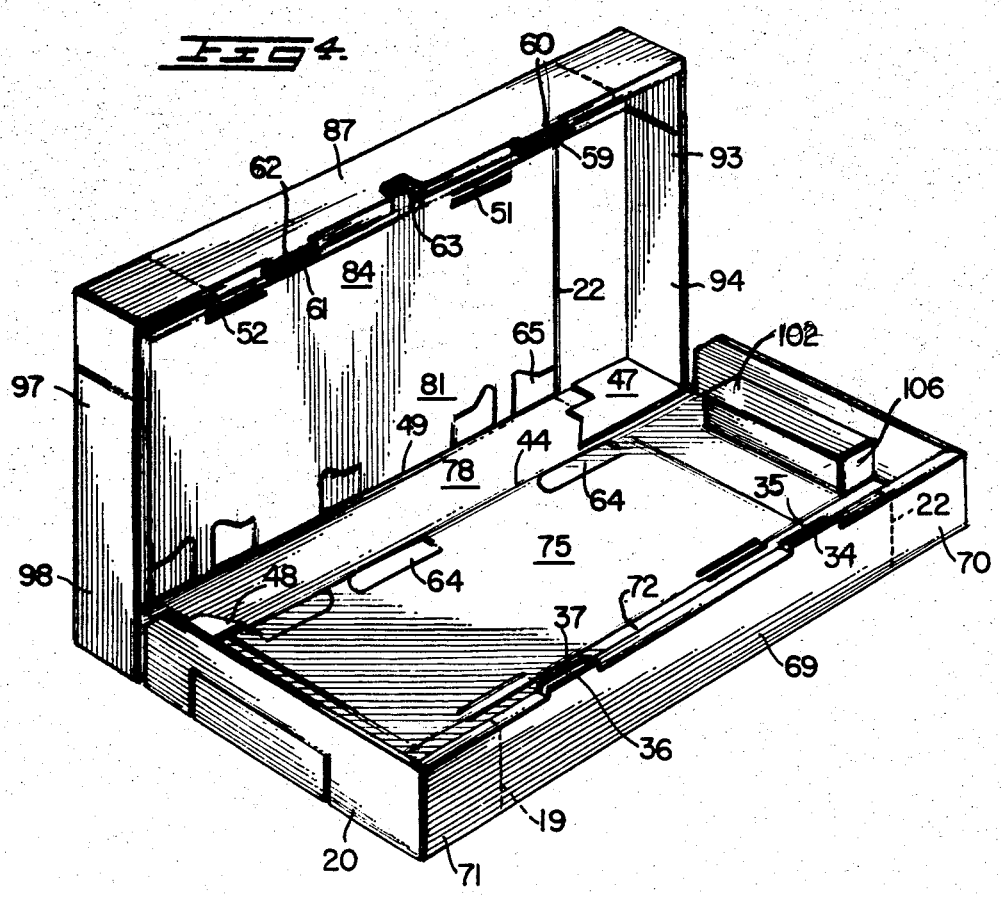
FIG. 4 is a view of the carton of FIG. 2 in opened condition to show the manner of folding of the elements of FIG. 1 to form the carton bottom and top.

As seen in FIG. 1, a secondary fold line **31*a* is disposed in a parallel, spaced relationship with the fold line 31. Fold line 31*a* is spaced from fold line 31 by a distance sufficient to permit the insertion of tabs 30 and 26 between the front wall of the carton as formed by a pair of panels 66 and 69, for example. In addition, the opposed tabs (or tab portions) 34 and 35 are formed by placing the cut 32 between the fold lines 31 and 31*a*, and the tabs (or tab portions) 36 and 37 are formed by placing a cut 33 between the fold lines 31 and 31*a*. As a result, upon folding the panels 66 and 69 together, a first set of tabs 36 and 37, and a second set of tabs 34 and 35 are formed extending substantially parallel of each other as shown in FIG. 4. As will be explained, these sets of tabs are arranged to engage corresponding first and second sets of slits 42 and 43 as shown in FIG. 1. In particular, the parallel extending tabs 34 and 35 (36 and 37) engage that portion of the blank between slits 42 (43), bending it outward from the surface of the panel 75 whereby slot 35 (37) engages the edge of the sheet exposed by bending the noted portion. It is preferred to use the noted sets of slits 42 and 43 as opposed to forming openings or slots so that in the larger configurations or sizes of the cartons (see FIG. 2**), openings are not left in the top or bottoms of the cartons.

In addition, an auxiliary fold line **38*a* is disposed in a parallel relationship with fold line 38 and is spaced therefrom a distance sufficient to permit the insertion of the aforementioned tabs between a pair of panels 69 and 72**, when they are folded to form a carton.

Fold line 49 in blank 10 is disposed parallel to fold line 44 and spaced therefrom the desired depth of the carton and forms the rear edge of the top of the formed carton rotating about fold line 44 when the carton is closed. Fold line 50 in blank 10 is disposed parallel to fold line 49 and the distance between fold lines 49 and 50 is slightly greater than that of fold lines 41 and 44 to permit the top of the carton, when in assembled condition, to fold over and embrace the bottom of the carton. Slots 51 and 52 in blank 10 are provided adjacent fold line 50 to receive tabs which will be described hereinafter.

A fold line 53 in blank 10 is parallel to and spaced from fold line 50 the desired depth of the carton and blank 10 is provided with slots 54 and 55 to receive tabs 15 and 16 as will appear more fully hereinafter. Fold line 56 in blank 10 is provided parallel to fold line 53 and spaced therefrom the desired depth of the carton and is cut away at 57 and 58 to provide facing tabs 59 and 60 and 61 and 62, respectively, for purposes which will appear more fully hereinafter.

In a manner similar to that described above, an auxiliary fold line **56*a* is disposed in a spaced, parallel relationship to fold line 56, as shown in FIG. 1. As a result of folding a pair of panels 87 and 90, a first set of tabs 59 and 60, and a second set of tabs 61 and 62 are formed to extend substantially parallel to each other and to engage respectively the first and second sets of slits 51 and 52. Further, an auxiliary fold line 53*a* is disposed in a spaced and parallel relationship to fold line 53. As mentioned above and as illustrated in FIG. 2, the use of the sets of slits 51 and 52 provide a continuous surface within the panel 81** without having slots or other openings therein.

Opening 63 is also provided medially of fold line 56 in blank 10 to provide a finger opening in the top of the carton assembled in largest size to facilitate opening of the carton.

Tabs 64 and 65 may be formed in blank 10 for inward folding in an assembled carton to steady or position the contents thereof, while forming or packing the carton.

For purposes hereinafter of explanation of the manner of folding blank 10 to form various size cartons, the portion thereof between fold line 31 and edge 13 will be identified as panel 66 with the ends thereof adjacent to fold lines 22 and 20 identified as tabs 67 and 68 and the portion of the blank between fold lines 31 and 38 will be identified as panel 69. The area of the blank between fold lines 38 and 41 will be identified as panel 72 having end tabs 73 and 74. The area of blank 10 between fold lines 41 and 44 will be identified as panel 75 having end tabs 76 and 77. The area of blank 10 between fold lines 44 and 49 will be identified as panel 78 having end tabs 79 and 80. The area of blank 10 between fold lines 49 and 50 will be identified as panel 81 having end tabs 82 and 83 while the area of blank 10 between fold lines 50 and 53 will be identified as panel 84 having end tabs 85 and 86. The area of blank 10 between fold lines 53 and 56 will be identified as panel 87 having end tabs 88 and 89 while the area of blank 10 between fold line 56 and edge 14 will be identified as panel 90 having end tabs 91 and 92.

The area of blank 10 between edge 11 and fold line 21 and fold lines 51 and 53 will be identified as tab 93 and the area between the fold line 21 and edge 11 and fold lines 49 and 50 as tab 94. The area between fold line 21 and edge 11 and fold lines 41 and 44 will be identified as tab 95 with the area of blank 10 between fold lines 38 and 41 and fold line 21 and edge 11 being tab 96.

The area of blank 10 between fold line 19 and edge 12 and fold lines 50 and 53 will be identified as tab 97 while tab 98 is the area of blank 10 between fold line 19 and edge 12 and fold lines 49 and 50. The area of blank 10 between fold lines 41 and 44 and fold line 19 and edge 12 will be identified as tab 99 with tab 100 defined between fold lines 38 and 41 and fold line 19 and edge 12.

To form the largest possible carton from blank 10, as seen in FIGS. 2, 3, 4, and 11, the portion of blank 10 between fold line 21 and edge 11 is folded around fold line 21 into vertical position perpendicular to the plane of blank 10 as is that portion of blank 10 between fold line 19 and edge 12 to form a panel for each of the top and bottom portions of the carton. Tabs 26 and 30 are then folded inwardly about fold line 38 to positions parallel to fold line 38. Panel 69 is then folded to vertical position about fold line 38 outside of tabs 26 and 30 and panel 66 is folded about fold line 31 inwardly over and embracing tabs 26 and 30 with panel 69 so that tabs 17 and 18 enter slots 39 and 40, respectively, to form and to lock the lateral edge panel of the bottom portion of the carton in position.

Figure 2:
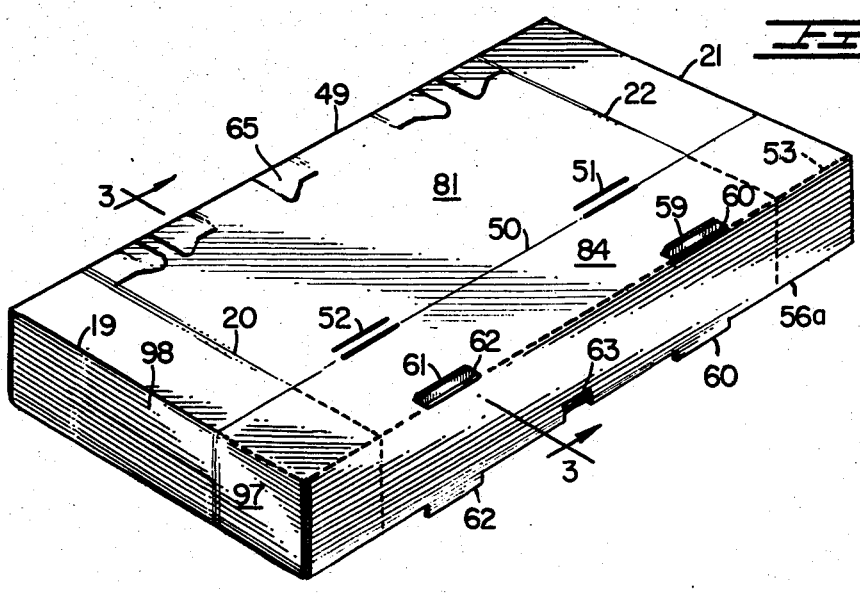
FIG. 2 is a perspective view of the largest size carton in a closed condition folded from the blank of FIG. 1.
Figure 3:
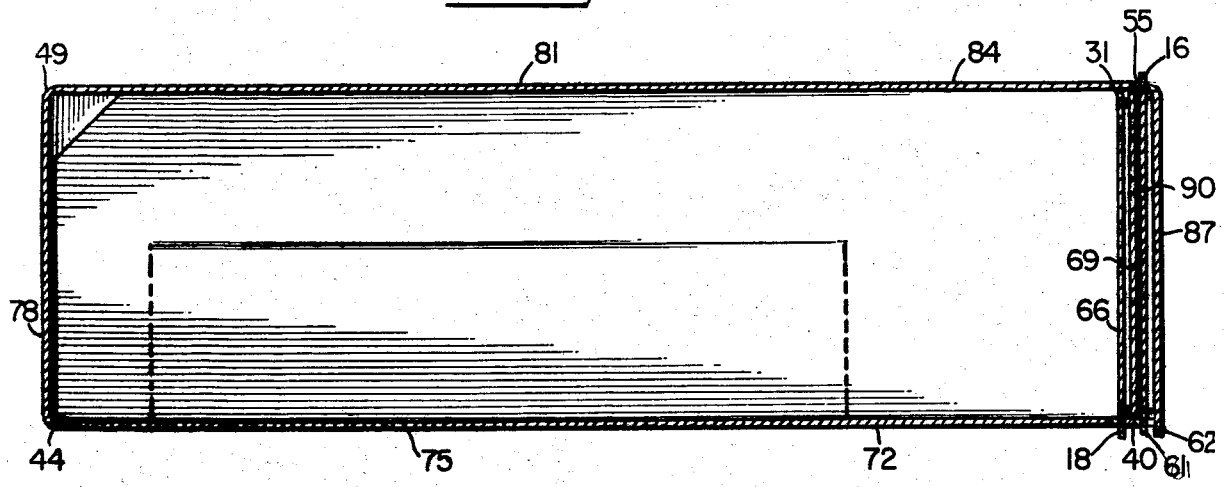
FIG. 3 is a cross-sectional view through the embodiment of FIG. 2 on the line 3 thereof.

Tabs 25 and 29 are then folded inwardly about fold line 53 to lie over fold line 53 and panels 87 and 90 are folded vertically about fold line 53 with panel 87 contacting tabs 25 and 29. Panel 90 is then folded over and downwardly to embrace tabs 25 and 29 with panel 87 so that tabs 15 and 16 enter slots 54 and 55, respectively, to form and to lock the front lateral edge panel of the top of the carton in position. Tabs 47 and 48 are then folded inwardly about fold line 49 to lie over fold line 49 and panels 81, 87 and 90 are then folded upwardly about fold line 49 until tabs 47 and 48 rest on panel 78. This position is clearly seen in FIG. 4. The contents of the carton may now be placed therein and the top of the carton as seen in FIG. 4 and to the left of fold line 44 of FIG. 1 is then folded about fold line 44 to position over and enclosing the bottom of the carton as shown in FIGS. 2 and 3.

The size of the resulting carton is shown in FIG. 11 where it is identified as size 1.

Figure 7:
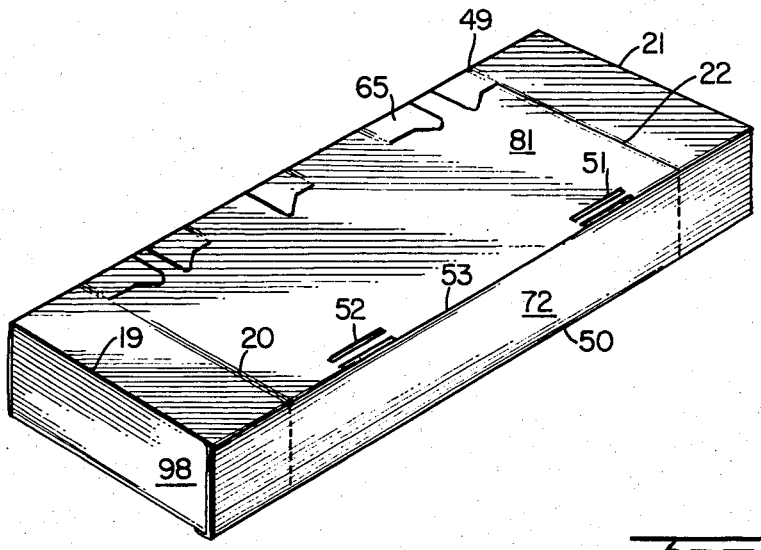
FIG. 7 is a perspective view of another size carton in closed condition formed from the blank of FIG. 1.
Figure 8:
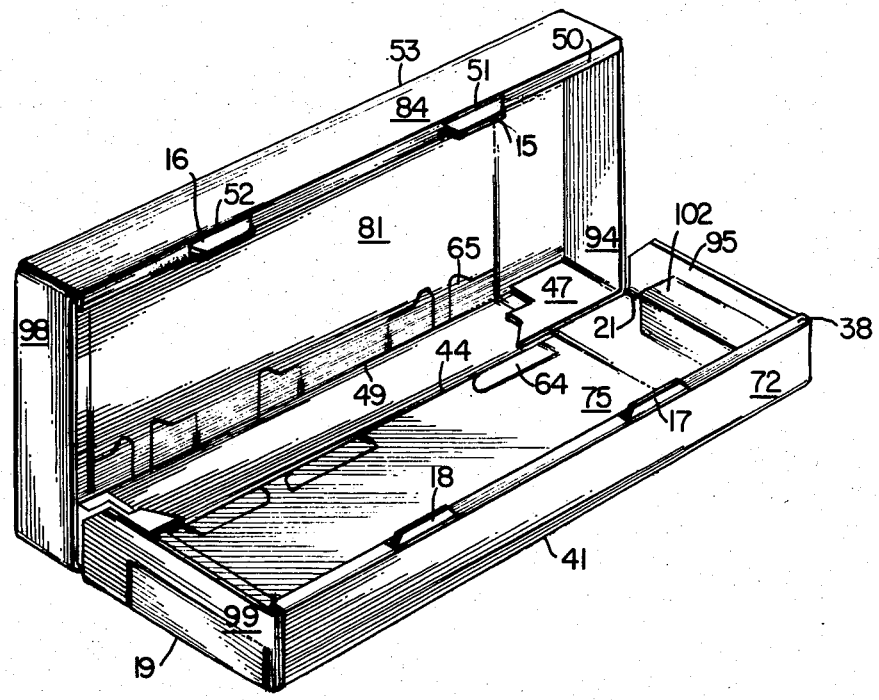
FIG. 8 is a view of the carton of FIG. 7 in open condition to show the manner of folding of the elements of the blank of FIG. 1 to obtain this size of carton.

It will be noted that size 2 as shown in FIG. 12 is of the same length as size 1 but narrower in width as seen in FIGS. 7 and 8. To fold the size 2 carton of FIGS. 7 and 8, the portion of blank 10 between fold line 21 and edge 11 is folded vertically to the plane thereof and the portion of blank 10 between fold line 19 and edge 12 is also folded vertically. After separating tab 96 from panel 73 as by tearing a perforated portion of the fold line 21, tabs 30 and 96 are then folded inwardly about fold line 41. After separating a perforated portion of fold line 19 extending between panel 74 and tab 100, tabs 26 and 100 are also folded inwardly about fold line 41 to lie thereover. Panel 66 is then folded around the fold line 31 to engage with panel 69 with tabs 17 and 18 entering slots 39 and 40, respectively, and then panel 69 carrying panel 66 is folded about fold line 38 into engagement with panels 30 and 96 and panels 26 and 100 to bring tabs 32 and 34 into engagement in slots 42 and to bring tabs 36 and 37 into engagement with slots 43 to lock the front of the bottom of the carton in position.

The top of the carton is then formed by tearing the perforated portion of fold line 21 lying between tab 93 and panel 82 and by bending tabs 29 and 93 inwardly about fold line 50. A perforated portion of fold line 19 disposed between tab 97 and panel 86 is torn and the tabs 25 and 97 are folded about fold line 53. Panel 90 is then folded about fold line 56 into engagement with panel 87. Panel 87 is then folded along fold line 53 into engagement with tabs 29 and 93 and tabs 25 and 97 to bring tabs 15 and 16 into engagement in slots 54 and 55. Panels 87 and 90 are then folded inwardly around fold line 50 to bring tabs 57 and 59 into engagement with slots 51 and to bring tabs 61 and 62 into engagement with slots 52 to lock the front of the top of the carton in position. Tabs 47 and 48 are then folded inwardly around fold line 49 to lie over fold line 49 and panels 81, 84, 87 and 90 are then folded around fold line 49 to complete the formation of the top, as clearly seen in FIG. 8. The contents of the carton may now be placed therein and the top of the carton then folded about fold line 44 into closed position surrounding and enclosing the bottom of the carton as seen in FIG. 7.

As shown in FIG. 1, a flap 102 is formed by placing cuts within the panels 95 and 76 of the sheet. A similar flap 104 is formed by placing cuts in panel 77 and 94. The use of these flaps 102 and 104 is more clearly shown in FIGS. 4 and 8, wherein there is shown the flap 102 as it is folded outward from the panels 95 and 76 to form a spacing element. It is understood, though not shown in FIGS. 4 and 8, that the flap 104 could be similarly folded out. In this manner, the assembled carton is capable of receiving objects of different size, i.e. smaller, to be held securely within the carton. Further, as shown in FIG. 4, an opening 106 is formed by the folded out flap 102, whereby the circulation of air and more specifically, cooling air is ensured throughout the closed carton. This is of significance where refrigerated products such as meat are stored within the assembled carton.

Figure 5:
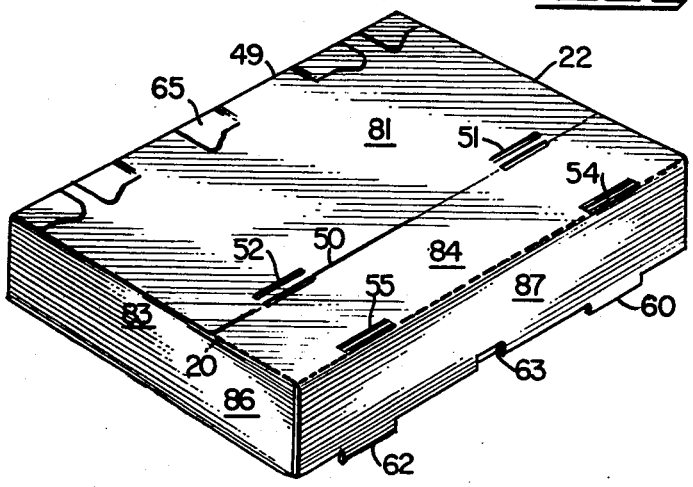
FIG. 5 is a perspective view of another size carton in closed condition formed from the blank of FIG. 1 and approximately square in shape.
Figure 6:
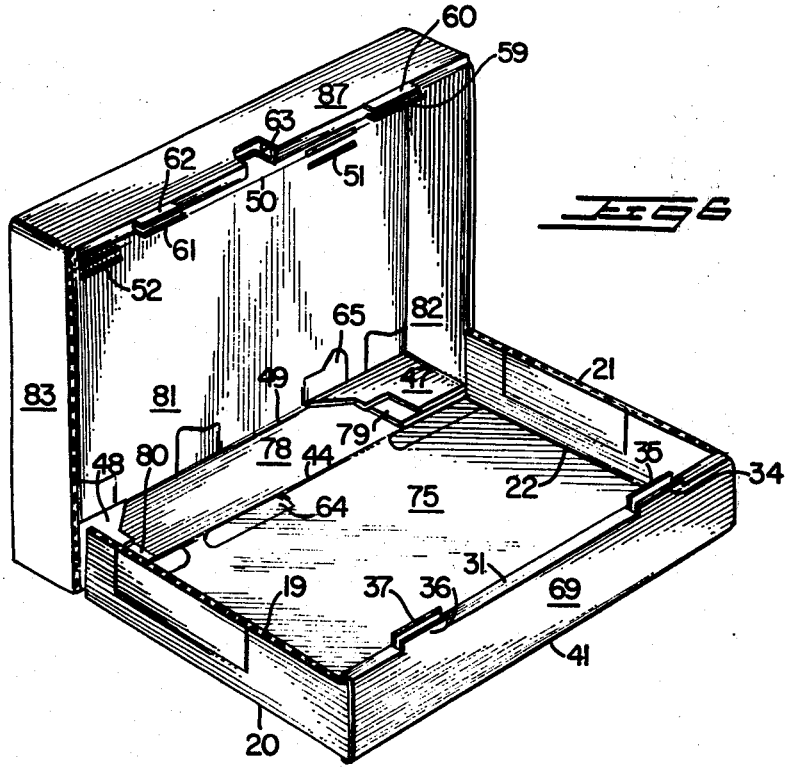
FIG. 6 is a view of the carton of FIG. 5 in opened condition to show the manner of folding of the components of the blank of FIG. 1 to form this size of carton.

Size 3 of the carton, as generally shown in FIG. 13, is shown in detail in FIGS. 5 and 6. This size of carton is obtained from the blank of FIG. 1 by folding that portion of the blank between fold line 21 and edge 11 around fold line 21 into contact with that portion of the blank lying between fold lines 21 and 22. The perforated portion of fold line 22 between edge 13 and fold line 38 is separated, and tabs 30, 67 and 70 are folded inwardly to overlie fold line 38. The perforated portion of fold line 22 from edge 14 to fold line 53 is separated, and tabs 29, 88 and 91 are folded about fold line 53 inwardly to overlie fold line 53. That portion of the blank lying between fold line 19 and edge 12 is folded around fold line 19 into engagement with that portion of the blank lying between fold line 20 and fold line 19. Fold line 20 is then perforated between edge 13 and fold line 38 and also perforated between edge 14 and fold line 53 with tabs 26, 68 and 71 folded inwardly to lie over fold line 38 and tabs 25, 89 and 92 folded inwardly to lie over fold line 53. Panel 66 is then folded around fold line 31 and panel 69 is folded around fold line 38 so that panel 66 lies over panel 69 engaging therebetween tabs 26, 68 and 71 and tabs 30, 67 and 70 with tabs 17 and 18 locking in slots 39 and 40, respectively, to complete the bottom of the carton.

Panel 90 is folded around fold line 56 to lie opposite panel 87 and to engage therebetween tabs 29, 88 and 91 and tabs 25, 89 and 92 with tabs 15 and 16 entering slots 54 and 55, respectively, to complete the formation of the top of the carton. This condition is clearly seen in FIG. 6. Tabs 48 and 80 and tabs 47 and 79 are then folded inwardly, with perforation of fold line 44 adjacent tabs 79 and 80, for engagement with panel 78 and panels 81, 84, 87 and 90 are folded about fold line 49 to the position seen in FIG. 6. The carton may then be filled and the entire top folded around fold line 44 to closed position with the top surrounding and enclosing the bottom of the carton as seen in FIG. 5.

Carton, size no. 4 of FIG. 14, the smallest carton which can be formed from the blank 10 of FIG. 1, is folded by a combination of foldings as shown in FIGS. 9 and 10. The portion of blank 10 lying between fold line 21 and edge 11 is folded around fold line 21 into engagement with that portion of the blank lying between fold lines 21 and 22. Fold line 22 is then perforated between fold line 50 and edge 14 and fold line 41 and edge 13 and the resulting double tabs are folded inwardly around fold line 50 and fold line 41, respectively. The portion of the blank 10 lying between fold line 19 and edge 12 is folded around fold line 19 into engagement with that portion of the blank 10 lying between fold lines 19 and 20 and fold line 20 is perforated between fold line 50 and edge 14 and between fold line 41 and edge 13. The double tabs thus formed are folded inwardly about fold line 50 and fold line 41, respectively, to overlie these fold lines. Next, panel 72 is folded about fold line 41 to be disposed substantially perpendicular to panel 75. Thereafter, panel 69 is folded about fold line 39 so as to enclose the double tabs that have been folded about fold line 41, engaging and retaining the double tabs between panels 69 and 72. In addition, the first set of tabs 34 and 35, and the second set of tabs 36 and 37 are disposed to engage respectively the first and second sets of slits 42 and 43. As shown in FIG. 10, the panel 66 is not enfolded between panels 69 and 72, but rather extends along panel 75. In this manner, the increased thickness of the aforementioned double tab may be received between the panel 69 and 72. If the panel 66 was also folded therebetween, it would increase the difficulty of inter-engaging the first and second sets of tabs with the first and second sets of slits 42 and 43 due to the increased spacing of panels 69 and 72.

It is noted that this configuration and method of folding differs from that described with respect to the size 2 carton as shown in FIG. 12, wherein, as shown in FIGS. 7 and 8, the panel 66 is first folded about fold line 31 so that the tabs 17 and 18 engage respectively to slots 39 and 40, and thereafter, the combined panels 66 and 69 are folded about fold line 38. In the embodiment of the size 2 carton, it is not necessary to receive and engage two sets of double tabs as must be accommodated with the embodiment of the size 4 carton.

In similar fashion, the top portion of the carton is formed, wherein the two sets of double tabs as formed about fold line 50 are received between panels 84 and 87, whereby the first set of tabs 59 and 60 and the second set of tabs 61 and 62 engage the first and second sets of slits 51 and 52 and the panel 90 extends along panel 81.

In the preferred embodiment of this invention as described above, the use of perforations between panels is minimized in that the extensive use of perforations in order to permit the tearing and possible removal of portions of the sheet is not desired in that it would tend to weaken the structural integrity of the assembled carton.

Panels 84, 87 and 90 are folded around fold line 50 into position vertical with respect to panel 81 and into engagement with the inturned tabs. Panels 87 and 90 are then rotated about fold line 53 with panel 87 engaging the inturned tabs with panel 84 and with tabs 59 and 60 engaging in slots 51 and tabs 61 and 62 engaging in slots 52. Panel 90 is folded about fold line 56 to lie flat against panel 81 as seen in FIG. 10. The carton may then receive its contents, and with tabs 48 and 80 and tabs 47 and 79 lying adjacent to panel 78, the top of the carton is rotated around fold line 44 to enclose and cover the bottom of the carton as seen in FIG. 9.

The blank 10 may be folded to form further sizes of the carton indicated as size 5 and size 6 in FIGS. 15 and 16, respectively. More specifically, to form the size 6 carton, the sheet is generally folded as indicated with respect to description of the size 1 carton, with the exception that one of the sides of the carton is further folded to reduce the dimension along the edge 13. For example, the sheet 10 is first folded along the fold line 21 and then along the fold line 22 to form a double, enfolded tab at either end of the fold line 22 to be secured within the panels forming the front lateral edge panels of the top and bottom portions of the carton, as described above. It is understood that the other edge could be so folded to form the carton of reduced length. The size 5 carton is formed in a manner similar to that of size 2, with the exception that one of the sides is double-folded to reduce the long dimension. In addition, as indicated above, further variation of the size of the carton may be secured by lifting one of the flaps 102 and 104.

Thus, there has been described a sheet capable of being formed into a great number of cartons of varying size to receive a wide assortment of products. In this manner, a single blank is capable of being used to ship and store a wide variety of products, thus reducing the inventory of different sizes and configurations of sheets.

What is claimed is:

1. A carton blank comprising a rectangular sheet of foldable material having spaced parallel first edges and spaced parallel second edges at right angles thereto, first spaced tabs extending from each of said second edges, first, second and third spaced parallel fold lines parallel to each of said second edges in said sheet, second spaced tabs in each of said first fold lines, first spaced slots in each of said second fold lines to receive said first spaced tabs, second spaced slots adjacent to said third fold lines to receive said second spaced tabs, fourth and fifth spaced parallel fold lines in said sheet parallel to each of said first edges, a sixth fold line in said sheet parallel to said second edges forming the rear bottom edge of the completed carton, a seventh fold line in said sheet spaced from and parallel to said sixth fold line forming the upper rear edge of the top of the completed carton, a first tab in said sheet disposed at one end and a second tab disposed at the other end of each of said fourth fold lines foldable about said second fold line and tabs in said sheet at each end of said sixth fold line foldable about said seventh fold line, said sixth and seventh fold lines being spaced from each other a distance substantially equal to the depth of the completed carton, each of said fourth fold lines including first and second end portions conditioned to be separated, said carton blank being foldable into at least first and second configurations of different size, in said first, relatively large configuration said carton blank being folded about its first and second fold lines, in said second, relatively small configuration said blank being folded about said first, second and third fold lines and said first and second end portions being separated to form larger first and second tabs.

2. The blank as claimed in claim 1, wherein each of said first slots has a width of a first dimension, and each of said second slots has a width of a second dimension less than that of said first dimension.

3. The blank as claimed in claim 2, wherein there is included third slots disposed on each of said third fold lines and adjacent corresponding of said second slots, and having a width equal to said second dimension.

4. The blank as claimed in claim 3, wherein there is included a secondary fold line disposed parallel to and relatively close to each of said first fold lines, said second tabs including a first tab portion extending from said second fold line and a second tab portion extending from said auxiliary fold line, whereby when said blank is folded about each of said second fold lines, said first and second tab portions extend in a generally parallel relation with each other to be received in that portion of the blank as bounded by the corresponding second and third slots.

5. A carton blank adapted to be folded and assembled to form cartons of varying size; said carton blank having a top portion including first and second side panels, a lateral edge panel, and a top panel; a bottom portion including first and second side panels, a lateral edge panel, and a bottom panel; said top and bottom portion being interconnected by a common edge panel, said carton blank comprising:

(a) a rectangular sheet of foldable material having first and second spaced relatively long edges, and third and fourth spaced parallel shorter edges disposed at substantially right angles to said first and second edges;

(b) first and second tab means extending respectively from said third and fourth edges;

(c) first, second and third fold lines disposed substantially parallel to each other and to said third edge;

(d) fourth, fifth and sixth fold lines disposed parallel to each other and to said fourth edge;

(e) third and fourth tab means disposed respectively at said first and fourth fold lines;

(f) first and second slot means disposed at said second and fifth fold lines to receive respectively said first and second tab means;

(g) third and fourth slot means disposed at said third and sixth fold lines to receive respectively said third and fourth tab means;

(h) seventh and eighth spaced parallel fold lines disposed parallel to said first edge, said seventh fold line having first and second end portions conditioned to be separated;

(i) ninth and tenth spaced parallel fold lines disposed parallel to said second edge, said ninth fold line having third and fourth end portions conditioned to be separated;

(j) eleventh and twelfth fold lines disposed respectively parallel to said third and fourth edges, and defining therebetween said common edge panel;

(k) first and second enfolded tabs being formed from said sheet at each end of said seventh fold line and being foldable about said second and fifth, or said third and sixth fold lines;

(l) third and fourth enfolded tabs being formed in said sheet at each end of said ninth fold line and being folded about said second and fifth, or said third and sixth fold lines;

(m) a first panel is defined between said third edge and said first fold line, a second panel is defined between said second fold line and said third fold line, a third panel is defined between said second fold line and said third fold line, a fourth panel is defined between said fourth edge and said fourth fold line, a fifth panel is defined between said fourth fold line and said fifth fold line and a sixth panel is defined between said fifth and sixth fold lines;

(n) said lateral edge panel of said top portion formable in a first manner by folding said sheet at said fifth fold line whereby said fifth panel overlies said sixth panel, said fourth panel overlies said top panel and said first and third end portions are separated to permit said first and third tabs to be folded about said sixth fold line, or in a second manner wherein said sheet is folded about said fourth fold line so that said fourth panel overlies said fifth panel and said sheet is further folded about said fifth fold line so that said fourth and fifth panels are substantially perpendicular to said sixth panel; said lateral edge panel of said bottom portion formable in the first manner wherein said sheet is folded about said second fold line whereby said second panel overlies said third panel, said first panel overlies said bottom panel, and said second and fourth end portions being separated to permit said second and fourth tabs to be folded about said third fold line, or in the second manner wherein said sheet is folded about said first fold line so that first panel overlies said second panel and said sheet is further folded about said second fold line so that said first and second panels are substantially perpendicular to said third panel.

6. The carton blank as claimed in claim 5, wherein the distance between said eleventh and twelfth fold lines is substantially equal to the depth of the assembled carton, said distance being substantially equal to each of the distances between said third edge and said first fold line, said first fold line and said second fold line, said second fold line and said third fold line, said fourth edge and said fourth fold line, said fourth fold line and said fifth fold line, said fifth fold line and said sixth fold line.

7. The carton blank as claimed in claim 6, wherein said distance is approximately equal to the distances between said first edge and said seventh fold line, said seventh fold line and said eighth fold line, said second edge and said ninth fold line, and said ninth fold line and said tenth fold line.

8. The carton blank as claimed in claim 5, the distance between said third fold line and said eleventh fold line being less than the distance between said sixth fold line and said eighth fold line.

9. The carton blank as claimed in claim 5, wherein each of said first and second slot means has a width of a first dimension, and each of said third and fourth slots has a width of a second dimension less than that of said first dimension.

10. The carton blank as claimed in claim 5, wherein each of said third and fourth slot means comprise first and second slits spaced from each other and defining portions of said sheet engagable by said third and fourth tab means to be disposed from the surface respectively of said sheet.

11. The blank as claimed in claim 10, wherein there is included a secondary fold line disposed parallel to and relatively close to each of said first and fourth fold lines, said third and fourth tab means each including a first tab portion extending from one of said first and fourth fold lines, and a second tab portion extending from said corresponding auxiliary fold line, whereby when said blank is folded about said second and fourth fold lines, said first and second tab portions extend in a generally parallel relation with each other to be received in that portion of said sheet as bounded by the corresponding first and second slits of said third and fourth slot means.

12. The carton blank as claimed in claim 5, wherein there is included tab positioning means formed within at least one of said top panel or bottom panel.

13. The carton blank as claimed in claim 5, wherein a flap is formed in said sheet comprising first and second slits through said sheet and spaced substantially parallel with each other between said third and eleventh fold lines and traversing said seventh fold line, whereby said flap is adapted to be disposed from its lateral edge panel to form a spacer element within the assembled carton.

14. The carton blank as claimed in claim 13, wherein a second flap is formed in said sheet comprising first and second slits through said sheet and spaced substantially parallel with each other between said third and eleventh fold lines and traversing said tenth fold line, whereby said second flap is adapted to be disposed from its lateral edge panel to form a spacer element within the assembled carton.

15. A carton blank adapted to be folded and assembled to form cartons of at least a first relatively large configuration and a second relatively small configuration; said carton blank including at least first and second side panels, a front edge panel disposed therebetween, and a lateral panel, said carton blank comprising:

(a) a rectangular sheet of foldable material having first and second spaced relatively long edges, and third and fourth spaced parallel shorter edges disposed at substantially right angles to said first and second edges;

(b) first tab means extending from said third edge;

(c) first, second and third fold lines disposed substantially parallel to each other and to said third edge;

(d) second tab means disposed at said first fold line;

(e) first slot means disposed at said second fold line to receive said first tab means;

(f) second slot means disposed at said third fold line to receive said second tab means;

(g) fourth and fifth parallel fold lines disposed parallel to said first edge, said fourth fold line having a first end portion conditioned to be separated;

(h) sixth and seventh spaced parallel fold lines disposed parallel to said second edge, said sixth fold line having a second end portion conditioned to be separated;

(i) first and second fold tabs being formed from said sheet at the ends of said fourth and sixth fold lines and being foldable about said second and third fold lines; and (j) a first panel as defined between said third edge and said first fold line, a second panel as defined between said second fold line and said third fold line, a third panel as defined between said second fold line and said third fold line; said front edge panel being formable in a first manner wherein said sheet is folded about said first and second fold lines whereby said second panel overlies said third panel and is folded about said third fold line whereby said first and second panels are substantially perpendicular to said lateral panel, and said first and second end portions of said fourth and sixth fold lines are separated to permit said first and second tabs to be folded about said third fold line, or in a second manner wherein said sheet is folded about said first fold line so that said first panel overlies said second panel, and said sheet is further folded about said second fold line so that first and second panels are substantially perpendicular to said lateral panel.

16. The carton blank as claimed in claim 15, wherein said second slot means comprise first and second slits spaced from each other and defining portions of said sheet engagable by said second tab means to be disposed from the surface respectively of said sheet.

17. The blank as claimed in claim 16, wherein there is included a secondary fold line disposed parallel to and relatively close to each of said first fold line, said second tab means including a first tab portion extending from said first fold line, and a second tab portion extending from said corresponding auxiliary fold line, whereby when said blank is folded about said second fold line, said first and second tab portions extend in a generally parallel relation with each other to be received in that portion of said sheet as bounded by the corresponding first and second slits of said second slot means.

18. The blank as claimed in claim 15, wherein said front edge panel is formed in said first manner, wherein said first panel overlies said lateral panel.

* * * * *